US006199859B1

(12) United States Patent
Schauer et al.

(10) Patent No.: US 6,199,859 B1
(45) Date of Patent: Mar. 13, 2001

(54) DEVICE FOR DE-CAMBERING A SUPPORTING MATERIAL

(75) Inventors: Christian Schauer; Helmut Naesser; Georg Boehmer, all of Munich (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/297,031

(22) PCT Filed: Oct. 20, 1997

(86) PCT No.: PCT/DE97/02419

§ 371 Date: Jul. 6, 1999

§ 102(e) Date: Jul. 6, 1999

(87) PCT Pub. No.: WO98/17566

PCT Pub. Date: Apr. 30, 1998

(30) Foreign Application Priority Data

Oct. 22, 1996 (DE) ..... 196 43 667

(51) Int. Cl.[7] ..... B65H 29/70

(52) U.S. Cl. ..... 271/188; 271/265.1; 271/273; 162/271; 399/406; 242/563; 242/566

(58) Field of Search ..... 226/196.1, 195; 399/406; 271/188, 273, 265.01; 242/566, 563; 162/271, 197, 270

(56) References Cited

U.S. PATENT DOCUMENTS

| | | | | |
|---|---|---|---|---|
| 2,737,089 | | 3/1956 | Baumgartner . | |
| 4,360,356 | | 11/1982 | Hall . | |
| 4,952,281 | * | 8/1990 | Akira | 162/270 |
| 5,153,662 | * | 10/1992 | Foos | 162/271 |
| 5,183,454 | * | 2/1993 | Kurosawa et al. | 162/271 |
| 5,202,737 | * | 4/1993 | Hollat | 162/271 |
| 5,287,157 | * | 2/1994 | Miyazato et al. | 162/197 |
| 5,539,511 | * | 7/1996 | Wenthe et al. | 162/270 |
| 5,565,971 | | 10/1996 | Kuo et al. . | |
| 5,717,836 | * | 2/1998 | Horie | 399/406 |
| 6,064,853 | * | 5/2000 | Embry et al. | 162/271 |

FOREIGN PATENT DOCUMENTS

| | | |
|---|---|---|
| 295 03 120 U1 | 8/1996 | (DE) . |
| 5-186116 | 7/1993 | (JP) . |
| 5-221574 | 8/1993 | (JP) . |
| WO/89/06634 | 7/1989 | (WO) . |

OTHER PUBLICATIONS

Japanese Abstract, Publication No. 05221574, Publication Date Aug. 31, 1993.

Japanese Abstract, Publication No. 05186116, Publication Date Jul. 27, 1993.

* cited by examiner

*Primary Examiner*—H. Grant Skaggs
(74) *Attorney, Agent, or Firm*—Schiff Hardin & Waite

(57) ABSTRACT

A paper decurling unit in a printer or copier provides a convex or concave path in the paper transport direction. The decurling device is adjustable.

11 Claims, 4 Drawing Sheets

DEVICE FOR DE-CAMBERING A SUPPORTING MATERIAL

The present invention is directed to a decurling unit according to the preamble of claim 1 for decurling carrier material.

In electrophotographic high-performance printers, the paper employed as carrier material curves concavely through convexly in the toner fixing due to the influence of pressure and heat. This curvature (curling in English) is thereby dependent on the paper quality, which is mainly defined by thickness, moisture and the manufacture, as well as on the number of fixings, i.e. of the selecting printing mode. Disproportionately much moisture is withdrawn from the paper in the first fixing. An especially pronounced curling of the paper therefore occurs therein compared to the second, third, etc., fixing. In a recent printing system having two printing units, for example, the number of fixings is dependent on the printing mode such as simplex, duplex, spot-color simplex, spot-color duplex printing.

The paper quality can be assumed to be constant within a paper stack but the plurality of fixings per sheet or per page cannot be assumed to be constant. Given employment of roll paper that, for example, is cut to format and the printer input given automatic delivery into a single sheet printer, the curvature of the supplied paper changing with the rolled diameter must be taken into consideration.

Decurling units (also known as "decurler" in German usage) are thus known, wherein the paper having only one deformation direction can be smoothed, i.e. concave or convex curvature. Such a known decurling unit bends the paper opposite the deformation direction. Given non-deformed, i.e. flat paper, this decurling unit dare not be used because would otherwise be deformed in it. A paper transport of smooth paper through such a decurling unit is therefore not possible.

U.S. Pat. No. 4,360,356 discloses a decurling means that optionally smooths concavely or convexly curved paper or through which smooth paper can be conducted without the paper being bent. The decurling means has two ledges proceeding parallel to one another that extend transverse to the conveying direction of the paper, as well as two drums extending parallel to the two ledges that are arranged immediately following the two ledges as viewed in conveying direction. The ledges and the drums are secured to a common swivelling means with which they can be swivelled in common around an axis proceeding transverse to the conveying direction. The paper is conducted through between the two ledges and the two drums, whereby respectively one ledge with the drum arranged diametrically opposite forms a decurling unit with which the convexly or, respectively, concavely curved paper can be smoothed. For smoothing the paper, the ledges and the drums are swivelled in common around the axis such that the paper running through the decurling means lies against one of the two ledges as well as the drum arranged diametrically opposite this under tension and is thereby decurled. When a smooth paper passes through the decurling means, the swivel means is placed such that the paper passes through between the ledges and the drums without touching these.

U.S. Pat. No. 5,565,971 discloses a decurling unit with which concavely or convexly curved carrier material can be optionally smoothed. To this end, the decurling unit has a stationary, first drum proceeding transverse to the conveying direction of the carrier material as well as a driven, rubberized, second drum proceeding parallel to the former, whereby both drums are secured to a common base plate.

For smoothing a concavely curved carrier material, a conveyor belt is pressed against the first drum with the assistance of a swivel means. An elastic conveying nip through which the carrier material to be smoothed is transported thereby forms between the conveyor belt and the drum. The decurled carrier material emerging from the elastic conveying nip is conducted past the second drum without touching it. In order to decurl a convexly curved carrier material, the carrier material is conducted past the revolving, second drum with the assistance of a deflection plate likewise provided at the swivel means, as a result whereof the carrier material is bent. In this position of the swivel means, the conveyor belt interacting with the first drum is deactivated, so that the carrier material is in fact conducted part the drum but without being bent by the conveyor belt and the first drum. Given this known decurling unit, there is then the problem that it can only be traversed by convexly or concavely curved carrier material. Smooth carrier material that is not deformed, by contrast, is unintentionally deformed by the decurling unit, so that the decurling unit is not suited for the employment of undeformed carrier material.

The invention is thus based on the object of offering a decurling unit that enables a smoothing of the carrier material independently of the deformation direction. In particular, carrier material without deformation should be capable of being smoothed by the decurling unit in addition to carrier material having a concave or a convex deformation.

This object is achieved with the decurling unit of the species initially cited on the basis of the characterizing features of claim 1. Advantageous developments derive from the subclaims.

Given the inventive decurling unit, the element for eliminating convexity is functionally coupled such to the element for eliminating concavity that, on the one hand, a decrease in the influence of the element for eliminating concavity occurs given an increase in the effect of the element for eliminating convexity and, on the other hand, an increase in the effect of the element for eliminating concavity occurs given a decrease in the effect of the element for eliminating convexity. This enables a continuous or graduated setting of the decurling unit between two extreme positions for eliminating extreme concavity or, respectively, extreme convexity.

In a specific development, the element for eliminating concavity is a decurling shaft having a rotational axis extending perpendicular to the conveying direction of the carrier material, whereby the decurling shaft can be immersed into one or more stretchable decurling belts that are arranged parallel to one another and drive it by static friction, said decurling belts being stretched between a drive roller and a deflection roller for the decurling belt or belts in conveying direction of the carrier material, whereby the rotational axes of the drive roller and of the deflection roller likewise extend perpendicular to the conveying direction of the carrier material, so that the decurling belt or belts lies or, respectively, lie against the decurling shaft in convex form. The elimination of the concavity ensues in that the concavely curved carrier material to be smoother is ceased between the decurling belt or belts and the decurling shaft immersed there into with a suitable emersion depth t and is convexly, oppositely bent between the belt and shaft.

Expediently, the element for eliminating convexity is a discharge contour shaped concavely in conveying direction of the carrier material that can be swiveled into the paper path around an angle. The convex paper is deformed in opposite direction by the concavely curved discharge contour that is pivoted out by a suitable pivot angle γ, a smoothing being achieved as a result thereof.

In an especially advantageous development, the element for eliminating concavity and the element for eliminating convexity are rigidly connected by a rodding and are pivotable together around a common rotational axis A.

As a result thereof, a mechanical drive of the rodding can simultaneously adjust the immersion depth t of the decurling shaft into the decurling belt and the swivel angle γ of the discharge contour. Given a swivel of the rodding in one direction, the immersion depth t and the swivel angle γ thereby increase, as a result whereof the concavity decurling is enhanced and the convexity decurling is reduced. Given an opposite pivot of the rodding, the immersion depth t and the swivel angle γ decrease, as a result whereof the concavity decurling is reduced and the convexity decurling is enhanced.

Expediently, the pivot of the rodding ensues with a toothed segment rigidly connected to the rodding via a pinion of a motor operator. This embodiment is especially simple and enables a continuously variable decurling of the carrier material on the basis of a corresponding, single-time rotation of the toothed segment.

As a result thereof, an uncomplicated, automatic re-adjustment of the decurling unit can ensue dependent on a parameter or on a combination of the parameters "initial curling condition of the carrier material", "selected printing mode" or "carrier material quality" on the basis of a direct drive of the motor operator.

Particularly given employment of wound-up roll paper that is cut at the printer input, the diameter of the roll is acquired and the motor operator of the decurling unit is driven on the basis of the acquired diameter. In this way, the inventive decurling means is constantly adapted to the curved condition of the wound-up paper at the printer input.

Further advantages, features and applied possibilities of the invention derive from the following description of a preferred exemplary embodiment of the invention on the basis of the accompanying drawing, whereby FIG. 1 shows a schematic illustration of the decurling procedure;

Figure 1:
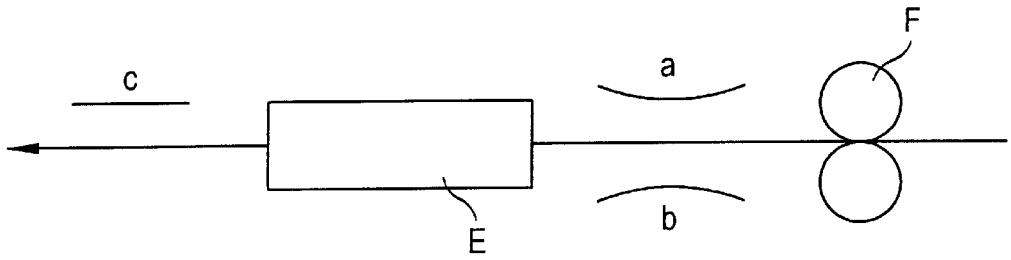

FIG. 1 schematically shows the smoothing procedure for concavely curved paper a and convexly curved paper b that is dejected from a fixing station F. The decurling unit E converts the concave or the convex paper into smooth paper c.

Figure 2:
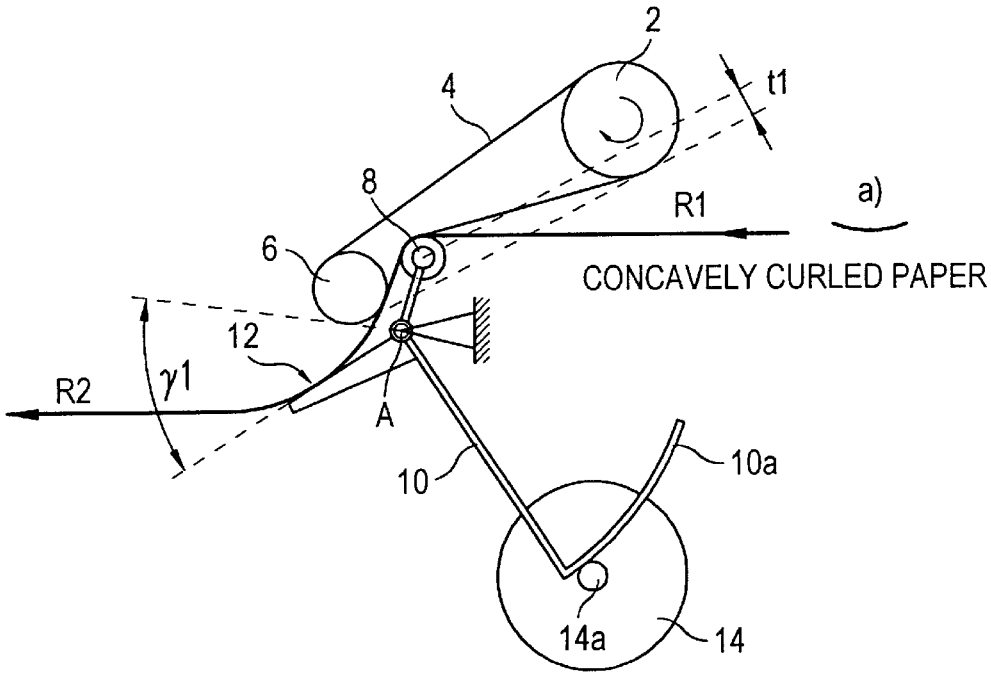
FIG. 2 shows a sectional view of a preferred, inventive decurling unit in a first setting.

FIG. 2 shows a sectional view of a preferred embodiment of the decurling unit in a first setting. A drive roller 2 and a deflection roller 6 each having respectively stationary axes perpendicular to the conveying direction of the paper (in the plane of the drawing) elect one or more decurling belts 4 arranged parallel to one another that are composed of a rubber-like, stretchable material. A decurling shaft 8 whose rotational axis is stationarily arranged at a pivotable rodding 10 around a stationary axis A dips into the stretched decurling belt or belts 4 with an immersion depth t1. This arrangement forms an element for eliminating concavity. A sheet of paper concavely (downwardly) curved supplied along the direction R is ceased at its leading edge by the rubber-like decurling belt 4 and by the decurling shaft 8 lying thereagainst and driven by it and is pulled in therebetween. Upon transport between the belt 4 and the shaft 8, the initially concavely curved sheet of paper has an opposite curvature impressed upon it, as a result whereof the initial, concave curvature is eliminated. The effect for eliminating concavity is all the greater the greater the penetration depth t1 is.

A discharge contour 12 having a concave curvature is pivoted out downward around a pivoting angle γ1. It forms an element for eliminating convexity. The sheet of paper delivered by the element for eliminating concavity is curved here opposite a potentially existing, convex curvature of the paper. The effect for eliminating convexity is all the weaker the greater the pivot angle γ1 is. The decurled paper is conducted farther in the direction R2.

Both the decurling shaft 8 as well as the discharge contour 12 are rigidly connected to the rotational axis A around which the rodding 10 can be pivoted. The pivot of the rodding 10 in counter-clockwise direction effects an increase in the penetration depth t1 and of the pivot angle γ1, as a result whereof the component for eliminating the concavity is intensified and the component for eliminating the convexity is weakened. A suitable setting for eliminating entering paper with a greater and greater concavity can therefore be achieved by pivoting the rodding in a counter-clockwise direction. This setting ensues via a toothed segment 10*a* rigidly connected to the rodding 10 that is in engagement with a pinion 14*a* of a motor operator 14.

Figure 3:
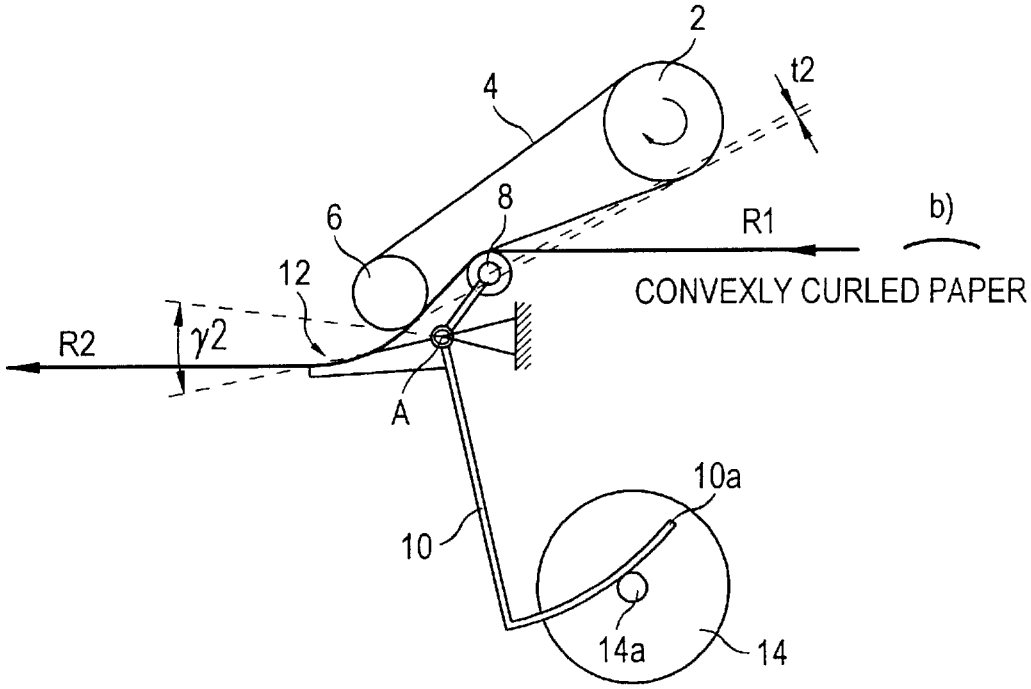
FIG. 3 shows a sectional view of the preferred, inventive decurling unit in a second setting.

FIG. 3 shows a sectional view of the preferred embodiment of the decurling in a second setting. The drive roller 2 and the deflection roller 6 again erect the one or more decurling belts 4. Here, the decurling shaft 8 immerses into the stretched decurling belt or belts 4 with a penetration depth t2 that is smaller than the penetration depth t1 of FIG. 1. A convexly upwardly curved sheet of paper introduced along the direction R1 is ceased at its leading edge by the decurling shaft 8 driven by the rubber-like decurling belt 4 and is drawn in therebetween. Upon transport between the belt 4 and the shaft 8, only a weakly convex curvature is impressed on the initially convexly curved sheet of paper, as a result whereof the initial convex curvature is at least not intensified. The convexly bending effect, i.e. the effect for eliminating concavity, is all the weaker the smaller the penetration depth t2 is.

The discharge contour 12 with its concave curvature is now pivoted out downward around a pivot angle γ2 that is smaller then the pivot angle γ1 of FIG. 1. The sheet of paper introduced from the element for eliminating concavity is curved here opposite a potentially existing, concave curvature of the paper. The effect for eliminating convexity is all the greater the smaller the pivot angle γ2 is.

The pivot of the rodding 10 in clockwise direction effects a decrease in the penetration depth t2 and of the pivot angle γ2, as a result whereof the components for eliminating the convexity is intensified. By pivoting the rodding in a clockwise direction, a suitable setting for eliminating paper entering with a greater and greater convexity can therefore be achieved here. This setting ensues via the tooth segment 10*a* rigidly connected to the rodding 10 that meshes with the pinion 14*a* of the motor operator 14.

FIG. 2 and FIG. 3 each respectively show a setting of the decurling unit for smoothing convexly or, respectively, concavely curved paper. Since the two settings for t and γ (t=t1, γ=γ1; t=t2, γ=γ2 with t1>t2 and γ1>γ2) can be continuously converted into one another by the drive of the motor operator 12, an intermediate position is also possible wherein the decurling unit behaves neutral and implements no curvature correction whatsoever. As a result thereof, uncurled sheets of paper can also be transported through the decurling unit without having these deformed. In this case, the decurling unit can be employed as a normal conveyor unit. Complicated shunt arrangements and case distinctions with different paper paths are thus eliminated.

Figure 4:
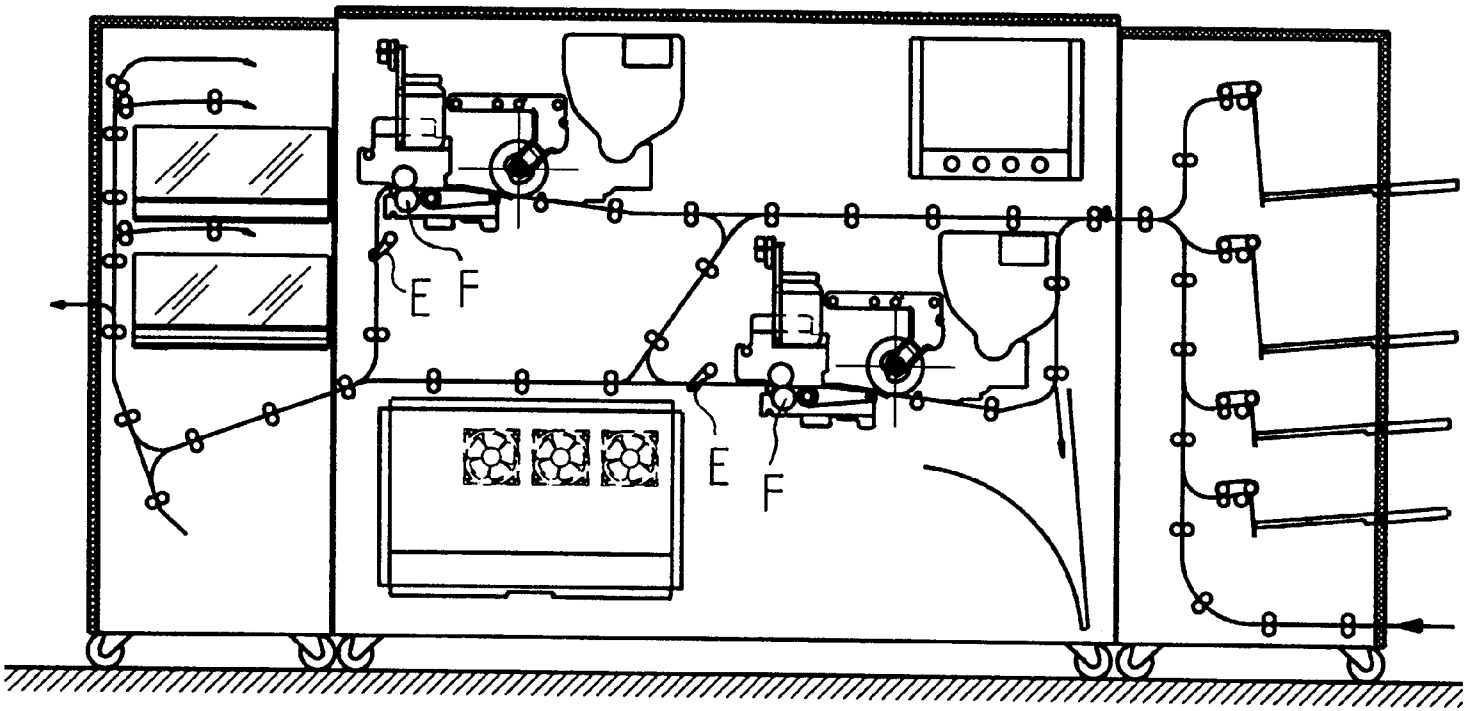
FIG. 4 shows a printer with integrated decurling units.

FIG. 4 shows a printer with integrated decurling units E that follow in the paper paths of two printer units each having a fixing station F. The compact nature of the decurling units E becomes clear here.

Figure 5:
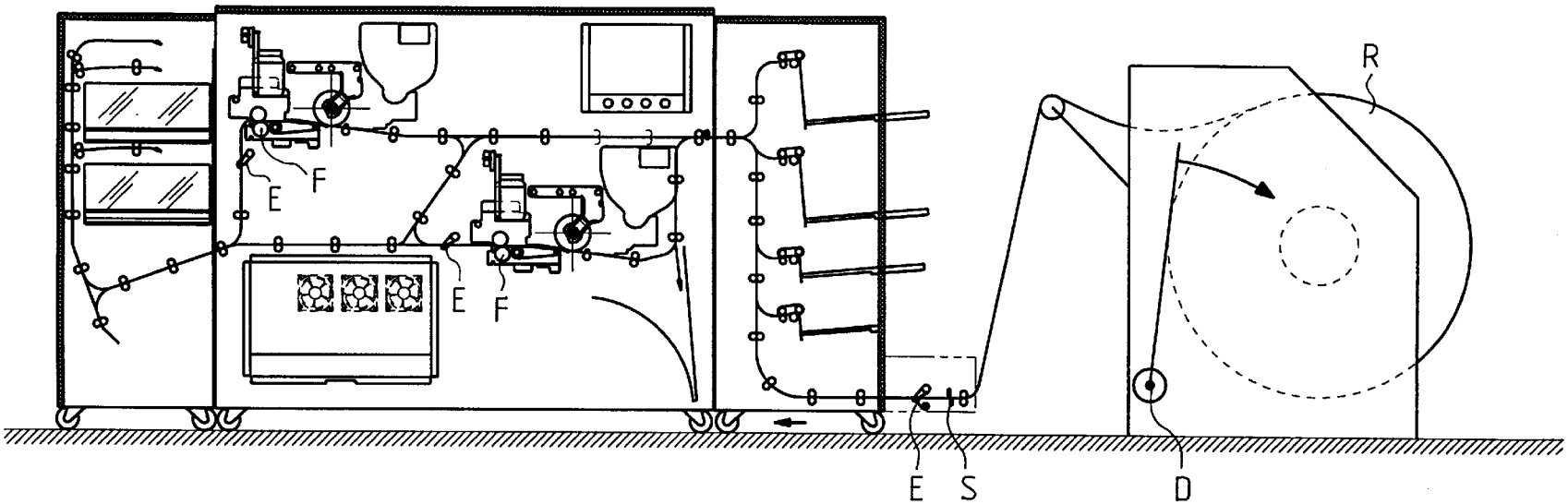
FIG. 5 shows the printer of FIG. 4 with a specific roll paper delivery.

FIG. 5 shows a printer arrangement given employment of roll paper R. Dependent on the roll diameter, the decurling unit E at the printer input following the cutting unit S is constantly re-adjusted. The roll diameter of the roll of roll paper R is acquired with a rotational sense sensor D with extension lever and serves as basis for the drive of the motor operator of the decurling unit E.

When copying or printing, for example, the paper quality is first selected by the operator at a control panel of the device via a constant that pre-sets the drive of the motor operator 14 and is secured by test prints. The additional re-adjustment of the decurling unit corresponding to the printing mode and the passes through the printing units resulting therefrom subsequently ensues automatically via the drive of the motor operator 14, similar to the drive on the basis of the diameter of the roll described in FIG. 5.

| LIST OF REFERENCE CHARACTERS | |
|---|---|
| 2 | Drive Roller |
| 4 | Decurling belt |
| 6 | Deflection roller |
| 8 | Decurling shaft |
| 10 | Rodding |
| 10a | Toothed segment |
| 12 | Discharge contour |
| 14 | Motor operator |
| 14a | Pinion |
| E | Decurling unit |
| F | Fixing station |
| R | Roll paper |
| S | Cutter unit |
| D | Rotational angle sensor |

What is claimed is:

1. A decurling unit for decurling sheet-shaped carrier material that has a potentially convex or concave curvature along a direction extending parallel to a conveying direction of the carrier material, comprising:

an element for eliminating convexity in the carrier material, said element for eliminating convexity being adjustable;

an element for eliminating concavity in the carrier material in series with said element for eliminating convexity, said element for eliminating convexity and said element for eliminating concavity both being traversed by the carrier material to be decurled, the element for elimination of concavity being adjustable; and a mechanical linkage between said element for eliminating concavity and said element for eliminating convexity so that a decrease of an effect of the element for eliminating concavity occurs given an increase in an effect of the element for eliminating convexity and an increase in the effect of the element for eliminating concavity occurs given a decrease in the effect of the element for eliminating convexity.

2. A decurling unit according to claim 1, wherein the element for eliminating concavity includes:

a decurling shaft having a rotational axis extending perpendicular to the conveying direction of the carrier material, at least one stretchable decurling belt connected to drive said decurling shaft by static friction, a drive roller and a deflection roller on either end of the decurling belt so that the decurling belt extends in a conveying direction of the carrier material, the drive roller and the deflection roller having rotational axes extending perpendicular to the conveying direction of the carrier material so that the decurling belt lies against the decurling shaft in convex form.

3. A decurling unit according to claim 1, wherein the element for eliminating convexity is a discharge contour that is concavely shaped in the conveying direction of the carrier material and that can be pivoted into the conveying path of the carrier material.

4. A decurling unit according to claim 1, further comprising:

rodding rigidly connecting the element for eliminating concavity and the element for eliminating convexity so that said element for eliminating concavity and said element for eliminating convexity are pivotable together around a common rotational axis.

5. A decurling unit according to claim 4, further comprising:

a toothed segment rigidly connected to the rodding via a pinion of a motor operator.

6. A decurling unit according to claim 1, wherein the decurling unit is automatically re-adjustable dependent on an initial curved condition of the carrier material.

7. A decurling unit according to claim 6, wherein the automatic re-adjustment ensues dependent on a selected printed mode.

8. A decurling unit according to claim 6, wherein the automatic re-adjustment ensues dependent on a quality of the carrier material.

9. A decurling unit according to claim 6, wherein the automatic re-adjustment ensues dependent on a combination of an initial curved condition of the carrier material, a selected printing mode and a quality of the carrier material.

10. A decurling unit according to claim 6, further comprising:

a motor operator for the decurling unit, wherein the automatic re-adjustment ensues by driving the motor operator of the decurling unit.

11. A decurling unit according to claim 10, further comprising:

a sensor for sensing a diameter of a wound paper roll at an input, said sensor being connected to drive the motor operator of the decurling unit depending on a diameter sensed by said sensor.

* * * * *